US007460068B2

(12) United States Patent
Takei et al.

(10) Patent No.: US 7,460,068 B2
(45) Date of Patent: Dec. 2, 2008

(54) DISTRIBUTED PHASE TYPE CIRCULAR POLARIZED WAVE ANTENNA, HIGH-FREQUENCY MODULE USING THE SAME, AND PORTABLE RADIO COMMUNICATION TERMINAL USING THE SAME

(75) Inventors: Ken Takei, Kawasaki (JP); Tomoyuki Ogawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 22 days.

(21) Appl. No.: 11/431,095

(22) Filed: May 10, 2006

(65) Prior Publication Data

US 2006/0267845 A1 Nov. 30, 2006

(30) Foreign Application Priority Data

May 11, 2005 (JP) ..... 2005-138644

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 6,040,806 A * 3/2000 Kushihi et al. ..... 343/853
6,995,709 B2 * 2/2006 Spittler ..... 343/700 MS
7,034,770 B2 * 4/2006 Yang et al. ..... 343/793
2004/0001021 A1 * 1/2004 Choo et al. ..... 343/700 MS

OTHER PUBLICATIONS

"Illustrated antenna (zusetsu antenna)", Naohisa Goto, 1995, Institutes of Electronics, Information and Communication Engineers, p. 219.

"Small size plane antenna", Misao Haneishi et al, 1996, Institute of Electronics, Information and Communication Engineers, pp. 143-145.

* cited by examiner

*Primary Examiner*—Hoang V Nguyen
*Assistant Examiner*—Robert Karacsony
(74) *Attorney, Agent, or Firm*—McGinn IP Law Group PLLC

(57) ABSTRACT

A distributed phase type circular polarized wave antenna provided with a plane, a power feed point 4 formed on the plane; and narrow conductor groups 1, 2 composed of narrow conductors 101 having a substantially one-dimensional current distribution, the narrow conductor groups being distributed in two dimension on the plane, and sums of projections of complex vectors of current distributions induced on the narrow conductors in first and second directions orthogonal to each other defined on the plane are determined in amplitude and phase, such that amplitudes are approximately equal to each other and a phase difference is approximately 90°.

13 Claims, 9 Drawing Sheets

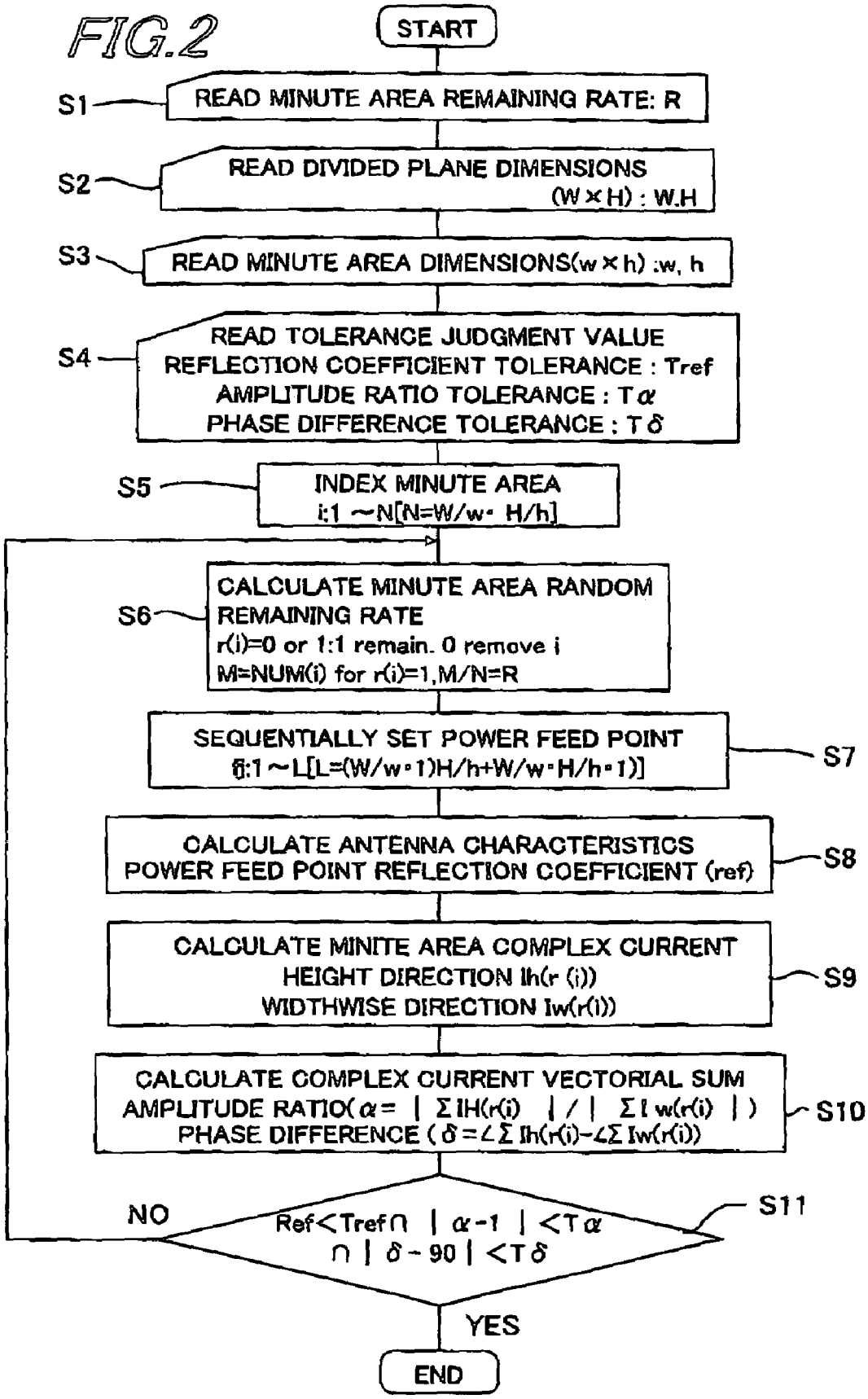
FIG.2
START
S1
READ MINUTE AREA REMAINING RATE: R
S2
READ DIVIDED PLANE DIMENSIONS
(W×H) : W.H
S3
READ MINUTE AREA DIMENSIONS(w×h) :w, h
S4
READ TOLERANCE JUDGMENT VALUE
REFLECTION COEFFICIENT TOLERANCE : Tref
AMPLITUDE RATIO TOLERANCE : Tα
PHASE DIFFERENCE TOLERANCE : Tδ
S5
INDEX MINUTE AREA
i:1 ~N[N=W/w· H/h]
S6
CALCULATE MINUTE AREA RANDOM
REMAINING RATE
r(i)=0 or 1:1 remain. 0 remove i
M=NUM(i) for r(i)=1,M/N=R
SEQUENTIALLY SET POWER FEED POINT
fj:1 ~L[L=(W/w·1)H/h+W/w·H/h·1)]
S7
CALCULATE ANTENNA CHARACTERISTICS
POWER FEED POINT REFLECTION COEFFICIENT (ref)
S8
CALCULATE MINITE AREA COMPLEX CURRENT
HEIGHT DIRECTION Ih(r (i))
WIDTHWISE DIRECTION Iw(r(i))
S9
CALCULATE COMPLEX CURRENT VECTORIAL SUM
AMPLITUDE RATIO(α= | ΣIH(r(i) | / | ΣI w(r(i) | )
PHASE DIFFERENCE ( δ=∠Σ Ih(r(i)-∠Σ Iw(r(i))
S10
NO
Ref<Tref∩ | α-1 | <Tα
∩ | δ-90 | <Tδ
S11
YES
END

DISTRIBUTED PHASE TYPE CIRCULAR POLARIZED WAVE ANTENNA, HIGH-FREQUENCY MODULE USING THE SAME, AND PORTABLE RADIO COMMUNICATION TERMINAL USING THE SAME

The present application is based on Japanese Patent Application No. 2005-138644 filed on May 11, 2005, the entire contents of which are incorporated herein by reference.

BACKGROUND OF THE INVENTION

1. Field of the Invention

The present invention relates to an antenna, a high-frequency module mounting the same, and a radio communication terminal that are applied to a radio communication-related equipment for providing a user with a radio communication system service, such as satellite broadcasting, global positioning system (GPS) using a circular polarized wave, in more particularly, to a small-sized thin type distributed phase type circular polarized wave antenna, a high-frequency module including the antenna, and a radio communication terminal mounting them, which is suitable for providing the user with information transmission radio communication system by the medium of electromagnetic wave having a wavelength greater than dimensions of the radio communication terminal.

2. Description of the Related Art

Among various radio communication system, many satellite-using systems such as seamless international telephone, satellite broadcasting, GPS, are operated, by making full use of advantages thereof, e.g. a seamless services over different countries can be provided, and a shielding effect of tall structures is small, since an electromagnetic wave used as a communication medium is transmitted from a substantially vertical (zenith) direction.

On one hand, the seamless services can be provided internationally. On the other hand, a possibility that the electromagnetic wave is leaked to other countries and other regions is inevitably high, so that different polarized waves (right-handed circular polarized wave and left-handed circular polarized wave) are assigned to neighboring countries and neighboring regions by using circular polarized wave, so as to solve the problem of electromagnetic wave leakage. The right-handed circular polarized wave cannot be received by a left-handed circular polarized wave antenna, and the left-handed circular polarized wave cannot be received by a right-handed circular polarized wave antenna. Only a half power of the circular polarized wave can be received by a linear polarized wave antenna. Therefore, so as to provide effectively the user with a radio communication services using the electromagnetic wave of a circular polarized wave, means for realizing the circular polarized wave antenna becomes an important technical problem.

As the means for realizing circular polarized wave antenna, tow methods are conventionally known and are put to practical use.

A first conventional method is to dispose two linear polarized wave antennas orthogonally to each other, and feeding phases of the respective antennas are shifted by 90°. A cross dipole is well known as a representative example of the first conventional method, as shown in "Illustrated antenna (zusetsu antenna)" by Naohisa Goto, 1995, Institute of Electronics, Information and Communication Engineers, page 219. However, in the first conventional method, two power feed parts are required, and means for shifting the respective power feed parts by 90° (e.g. phase converter) are further required. In the first conventional method, there is a disadvantage in that a circuit size of a radio communication device using the antenna is enlarged, so that there is problem in miniaturization of the radio communication device.

A second conventional method is to use a periphery-opened patch antenna such as a microstrip antenna, namely, to realize a circular polarized wave antenna with a single power feed point by using a rectangular or circular two-dimensional patch, which extends along two axes orthogonal to each other. For example, as shown in "Small size plane antenna" by Misao Haneishi et al, 1996, Institute of Electronics, Information and Communication Engineers, pages 143 to 145, a regular square or circle is such deformed that one side is shorter and another side is longer along the two axes orthogonal to each other. As a result, a length of one side of the regular square or a half circumference length of one side of the circle is made different from another side, and the length of each side is slightly shorter or longer than ½ wavelength of the receiving wavelength. Viewed from a power feed point, the length of the side along the respective axes orthogonal to each other functions as inductance or capacitance, and a feeding phase to the length of the side of the respective axes is shifted by 90°. The second conventional method is more advantageous than the first conventional method, since only the single power feed point is provided and a circuit size of a high-frequency circuit for supplying a high-frequency power to the antenna can be significantly reduced. Therefore, the second conventional method is actually most commercialized.

However, when using the second conventional method, two-dimensional size of substantially ½ wavelength of the radio wave received by the antenna should be assured as outer dimensions of the antenna, namely, an area of a regular square having one side of substantially ½ wavelength should be assured. Accordingly, there is an obstacle for application to a palm sized small terminal that is currently desired.

In a related application, the Inventors are proposing a distributed phase type circular polarized wave antenna based on a novel theory, which is composed of a group of plate conductor lines positioned with a predetermined pattern. In micro conductor segments constituting the predetermined pattern of the plate conductor lines, complex vectorial sums of respective projections of current induced in each segments of the plate conductor lines in two directions orthogonal to each other in the two-dimensional plane are determined, such that amplitudes of the complex vectorial sums are approximately equal to each other in the two directions and a phase difference between the complex vectorial sums in the two directions is approximately 90°. In the related application, it is described that the polarized circular wave antenna having outer dimensions of approximately ¼ wavelength can be realized. However, since 1.5 GHz band frequency is used in the GPS which represents the positioning information system using the satellite, the dimension for ¼ wavelength is about 5 cm. Therefore, even through the wavelength compact effect is added by using an inexpensive multi-purpose dielectric material that is often used in a printed circuit board, etc. with a maximum dielectric constant of 10, the dimension of the antenna is around 2 cm. With considering the installation of the antenna in a small sized radio communication device such as mobile telephone, further miniaturization is desired.

So as to reduce the dimensions of the antenna, the second conventional method or the related application proposes the technology for miniaturizing an antenna by using the wavelength compact effect of the dielectric material, in which the antenna is lined with or covered with a dielectric material having a high dielectric constant.

However, another problem in miniaturization is occurred, for example, a fabrication cost is increased by using the dielectric material having the high dielectric constant, and a dimension of the dielectric material in a thickness direction is increased so as to mostly produce the wavelength compact effect of the dielectric material. Therefore, a novel type miniaturization is desired.

SUMMARY OF THE INVENTION

Accordingly, it is an object of the present invention to provide a distributed phase type circular polarized wave antenna, which provides the user with a radio communication service using an electromagnetic wave of circular polarized wave, represented by a satellite radio communication system, with a single feed which is the simplest in structure and small and thin dimensions, and without adding a separate medium such as dielectric material for realizing wavelength compact effect that may cause an increase in cost.

It is another object of the invention to provide a high-frequency module using the circular polarized wave antenna.

It is still another object of the invention to provide a radio communication terminal using the circular polarized wave antenna.

In brief, it is an object of the present invention to provide a small and thin distributed phase type circular polarized wave antenna.

According to the first feature of the invention, a distributed phase type circular polarized wave antenna, comprises;

a plane;

a power feed point formed on the plane; and a plurality of narrow conductors having a substantially one-dimensional current distribution, the narrow conductor groups being distributed in two dimension on the plane;

wherein:

sums of projections of complex vectors of current distributions induced on the narrow conductors in first and second directions orthogonal to each other defined on the plane are determined in amplitude and phase, such that amplitudes are approximately equal to each other and a phase difference is approximately 90°.

In the distributed phase type circular polarized wave antenna, it is preferable that the narrow conductors are coupled to each other and the power feed point is included in the narrow conductors.

In the distributed phase type circular polarized wave antenna, the narrow conductors may be formed on a grounded conductor plate having a finite grounding potential.

In the distributed phase type circular polarized wave antenna, a space between the narrow conductors and the conductor plate may be filled with a dielectric material.

The distributed phase type circular polarized wave antenna may further comprises:

a coaxial cable having an end coupled to the power feed point and another end being a power feed point for connection to outside.

The distributed phase type circular polarized wave antenna may further comprises:

a flexible printed cable having an end coupled to the power feed point and another end being a power feed point for connection to outside.

According to the second feature of the invention, a high-frequency module comprises:

a distributed phase type circular polarized wave antenna which comprises:

a plane;

a power feed point formed on the plane; and a plurality of narrow conductors having a substantially one-dimensional current distribution, the narrow conductor groups being distributed in two dimension on the plane;

wherein:

sums of projections of complex vectors of current distributions induced on the narrow conductors in first and second directions orthogonal to each other defined on the plane are determined in amplitude and phase, such that amplitudes are approximately equal to each other and a phase difference is approximately 90°.

According to the third feature of the invention, a portable radio communication terminal comprises:

a distributed phase type circular polarized wave antenna which comprises:

a plane;

a power feed point formed on the plane; and a plurality of narrow conductors having a substantially one-dimensional current distribution, the narrow conductor groups being distributed in two dimension on the plane;

wherein:

sums of projections of complex vectors of current distributions induced on the narrow conductors in first and second directions orthogonal to each other defined on the plane are determined in amplitude and phase, such that amplitudes are approximately equal to each other and a phase difference is approximately 90°.

According to the fourth feature of the invention, a portable radio communication terminal comprises:

a high-frequency module including a distributed phase type circular polarized wave antenna which comprises:

a plane;

a power feed point formed on the plane; and a plurality of narrow conductors having a substantially one-dimensional current distribution, the narrow conductor groups being distributed in two dimension on the plane;

wherein:

sums of projections of complex vectors of current distributions induced on the narrow conductors in first and second directions orthogonal to each other defined on the plane are determined in amplitude and phase, such that amplitudes are approximately equal to each other and a phase difference is approximately 90°.

According to the present invention, it is possible to realize a small and thin circular polarized wave antenna.

BRIEF DESCRIPTION OF THE DRAWINGS

Preferred embodiments present invention will be described in conjunction with appended drawings, wherein;

FIGS. 1A to 1E are schematic diagrams showing a distributed phase type circular polarized wave antenna in a first preferred embodiment according to the invention, wherein FIG. 1A is a perspective view showing a structure of the distributed phase type circular polarized wave antenna, FIG. 1B is a side view of the distributed phase type circular polarized wave antenna viewed from a point A, FIG. 1C is a side view of the distributed phase type circular polarized wave antenna viewed from a point B, FIG. 1D is a conductor pattern of a first conductor plate, and FIG. 1E is a conductor pattern of a second conductor plate;

FIG. 2 is a flow chart showing a method for searching the conductor pattern of the distributed phase type circular polarized wave antenna in the first preferred embodiment according to the invention;

FIGS. 11A and 11B are schematic diagrams showing a high-frequency module using the distributed phase type circular polarized wave antenna in a tenth preferred embodiment according to the invention, wherein FIG. 11A is a perspective view of the high-frequency module and FIG. 11B is a cross sectional view of the high-frequency module viewed cut along A-A line;

DETAILED DESCRIPTION OF THE PREFERRED EMBODIMENTS

Figure 1A:
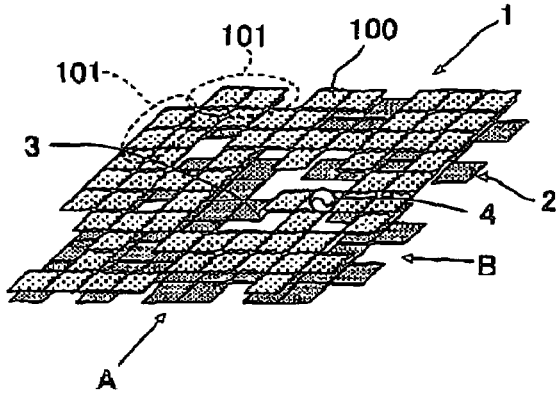

Next, preferred embodiments according to the present invention will be explained in more detail in conjunction with appended drawings.

Firstly, a distributed phase type circular polarized wave antenna according to the present invention will be explained theoretically.

A distributed phase type circular polarized wave antenna according to the present invention realizes a circular polarized operation with a thin plate and small dimension structure, and has a collective structure of narrow conductor lines.

The object of the present invention is to provide a thin and small sized distributed phase type circular polarized wave antenna, and a high-frequency module using the distributed phase type circular polarized wave antenna. As means for solving this problem, a distributed phase type circular polarized wave antenna comprises layered conductor plates, each composed a group of narrow conductor lines is provided. In this distributed phase type circular polarized wave antenna, the group of the narrow conductor lines are laid out in a two-dimensional plane, and a sum of projections of complex vectors of induced current at each point of the laid out narrow conductor lines to two axes orthogonal to each other that are provided on a same plane is calculated for each axis with considering a phase delay. The amplitudes of the sums of respective axes are equal to each other and a phase difference in the sums of the respective axes is 90°.

As described in the "Small size plane antenna" by Misao Haneishi et al, 1996, Institute of Electronics, Information and Communication Engineers, pages 143 to 145, when considering a circular polarized wave from a view point of a receiving side of the circular polarized wave, the circular polarized wave antenna is a plane perpendicular to a direction along which the circular polarized wave is transmitted, in which electromagnetic waves in two directions orthogonal to each other have an equal intensity and phases different from each other by 90°.

According to the theories of the electromagnetic, a direction of a current flowing on the conductor and a direction of an electric field of an electromagnetic wave generated by the current are identical when viewed from a far point. Therefore, if following conditions are satisfied, a novel circular polarized wave antenna can be realized. Firstly, a group of narrow conductor lines composing the antenna are formed on a same plane (that is a virtual plane in the present application) and one point in the group of narrow conductor lines is provided as a power feed point. Each of the narrow conductor lines is divided to be small enough (1/50 or less). Then, a sum of projections of complex vectors of induced current at each divided point to two axes orthogonal to each other that are arbitrarily provided on a same plane is calculated for each axis. If amplitudes of the sums of respective axes are equal to each other and a phase difference in the sums of the respective axes is 90°, the group of the narrow conductor lines composes a circular polarized wave antenna.

However, in this antenna, a limit of a spatial phase difference in different narrow conductor lines that can exist on a patterned conductor plate composed of a collective of the narrow conductor lines is a diagonal line of the patterned plate conductor. Following the operation principle of the circular polarized wave antenna of the above application, a plurality of groups of the narrow conductor lines each having a spatial phase difference of approximately 90° is required. Therefore, it is impossible for principle to realize a square antenna in which a diagonal line is ¼ wavelength or less. In particular, it is extremely difficult to realize a circular polarized wave antenna with an excellent axis ratio, in which one side of the square antenna dimension is ¼ wavelength or less.

Accordingly, in the present invention, based on the operation principle of the antenna proposed by the Inventors, two patterned conductor plates are disposed to be opposed to each other, and the power is fed between respective points on the respective conductor plates, namely, between one point on one conductor plate and one point on another conductor plate. According to this structure, the limit of the spatial phase difference between two different elements in the collective of the narrow conductor lines composed of two conductor plates is relaxed to be two times greater than that in an antenna comprising a single patterned conductor plate. As a result, assuming that the wavelength is fixed, the antenna dimension can be reduced to be approximately ½ of the conventional antenna.

According to present invention, since a small sized single feed circular polarized wave antenna can be realized, it is possible to realize a small sized circular polarized wave antenna without further increasing the fabrication cost, and a thin type module including the small sized antenna. Further, it is effective for miniaturization of radio communication terminal in a radio communication system using the circular polarized wave by using the small sized thin type antenna and module.

Various design algorithms for producing a concrete antenna structure according to the present invention may be proposed. As the simplest algorithm, following method may be proposed. Firstly, an area to be occupied by an antenna is previously provided. The area is divided into minute areas (for example, rectangular areas). Then, a calculator randomly determines as to whether a conductor remains or not in each of the divided minute areas. On a conductor distribution pattern corresponding to a group of the narrow conductor lines obtained by the above calculation (dimensions of the minute area correspond to a narrow conductor), a power feed point is randomly selected, to provide probable circular polarized wave antennas according to the novel principle. Finally, the probable circular polarized wave antennas (candidate antennas) are examined as needed whether a circular polarized wave can be really generated.

In one example obtained by the random search, as shown in FIG. 1, it is possible to provide a small sized circular polarized wave antenna with a finite thickness, in which two regular square conductors are disposed to be opposed to each other. Each of the regular square conductors has dimensions less than ⅛ wavelength and a distance between the two regular square conductors is 1/10 or less of the dimensions of the regular square conductor. The obtained results demonstrates that the small sized circular polarized wave antenna can be realized without increasing the fabrication cost, since a single feed circular polarized wave antenna having dimensions significantly smaller than that of the conventional circular polarized wave antenna, in which one side length of the regular square is substantially ¼ wavelength to ½ wavelength, is realized without using a wavelength compact material such as dielectric material.

Next, a distributed phase type circular polarized wave antenna in a first preferred embodiment according to the invention will be explained referring to FIG. 1.

Figure 1B:
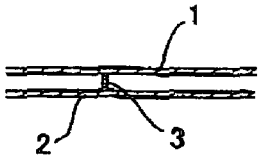
Figure 1C:
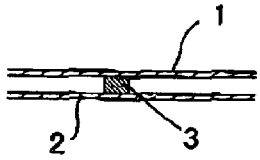
Figure 1D:
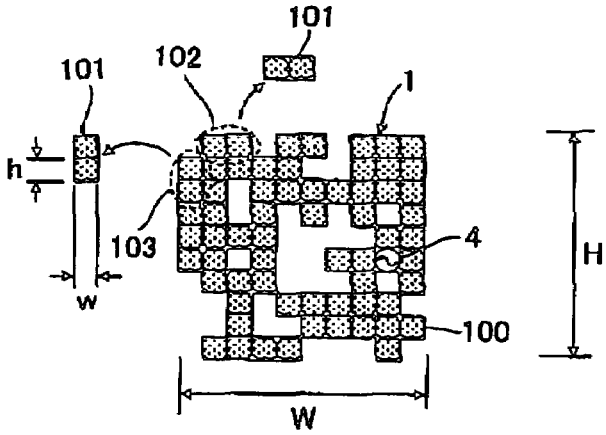
Figure 1E:
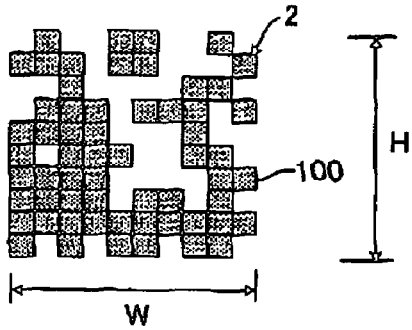

FIGS. 1A to 1E are schematic diagrams showing a distributed phase type circular polarized wave antenna in the first preferred embodiment according to the invention, wherein FIG. 1A is a perspective view showing a structure of the distributed phase type circular polarized wave antenna, FIG. 1B is a side view of the distributed phase type circular polarized wave antenna viewed from a point A, FIG. 1C is a side view of the distributed phase type circular polarized wave antenna viewed from a point B, FIG. 1D is a conductor pattern of a first conductor plate, and FIG. 1E is a conductor pattern of a second conductor plate.

A phase distributed type circular polarized wave antenna comprises a first conductor plate 1 composed of a plurality of rectangular conductors 100, a second conductor plate 2 composed of a plurality of the rectangular conductors 100, and a coupling conductor 3 having dimensions approximately smaller than those of the rectangular conductor 100, for electrically coupling the first conductor plate 1 and the second conductor plate 2. The first conductor plate 1 and the second conductor plate 2 are planarly opposed to each other, and one of the rectangular conductors 100 constituting the first conductor plate 1 and one of the rectangular conductors 100 constituting the second conductor plate 2 are connected by the coupling conductor 3.

A vacant space is provided between different rectangular conductors 100 constituting the first conductor plate 1, and power is fed to the different rectangular conductors 100 by using the gap as a power feed point 4. A narrow conductor 101 is formed by adjacent ones of the rectangular conductors 100 constituting the first and second conductor plates 1, 2. At this time, different narrow conductors 101 may be commonly composed of same regular conductors 100.

As shown in FIG. 1D, in a region circled by a broken line 102, a narrow conductor 101 comprises two rectangular conductors 100 disposed in W direction. In a region circled by a broken line 103, a narrow conductor 101 comprises two rectangular conductors 100 disposed in H direction. As described above, the distributed phase type circular polarized wave antenna comprises a power feed point 4, and a group of narrow conductors 101 formed on a plane (virtual plane), in which the narrow conductors each having an approximately one-dimensional current distribution are two-dimensionally distributed. The group of narrow conductors is the first conductor plate 1 or the second conductor plate 2.

A high-frequency current is induced n the narrow conductor 101. In the first preferred embodiment, a sum of projections of complex vectors of induced current on all of the narrow conductors 101 constituting the first conductor plate 1 with respect to two axes orthogonal to each other that are virtually provided on a the first conductor plate 1 is calculated. Then a sum of projections of complex vectors of induced current on all of the narrow conductors 101 constituting the second conductor plate 2 with respect to two axes orthogonal to each other that are virtually provided on a the second conductor plate 2 is multiplied by a phase difference corresponding to an opposing distance between the first conductor plate 1 and the second conductor plate 2 by using an exponential function for a given complex argument. A plurality of the rectangular conductors 100 are arranged to constitute the first conductor plate 1 and the second conductor plate 2, such that amplitudes with respect to the two axes orthogonal to each other are equal to each other and a phase difference with respect to the two axes orthogonal to each other is approximately 90°, when thus obtained values are computed by vector addition.

Next, the above theory will be explained in more detail.

Firstly, an X-axis and a Y-axis virtually orthogonal to each other are determined on the first conductor plate 1. The first conductor plate 1 and the second conductor plate 2 are composed of the rectangular conductors 100, respectively. The narrow conductor 101 is composed of a pair of adjacent rectangular conductors 100.

When a high-frequency power is applied to the first and second conductor plates 1, 2, the current is induced on the first and second conductor plates 1, 2, so that a current vector is formed in the longitudinal direction on the narrow conductor 101. The current vector is projected with respect to the predetermined X-axis and Y-axis. Herein, a plurality of the narrow conductors 101 are provided, so that it is assumed that the number of the current vectors corresponds to the number of the narrow conductors 101. Each current vector has particular amplitude and phase, and can be expressed by the complex number, wherein the absolute value corresponds to the amplitude and the argument corresponds to the phase.

Next, as for all the current vectors, the projection of the X-axis and the projection of the Y-axis are calculated then the sum of complex number is calculated.

A distance d is provided between the first conductor plate 1 and the second conductor plate 2 in the direction that is orthogonal to the X-axis and Y-axis.

A phase difference in the orthogonal direction equals to the distance d divided by a wavelength of the high-frequency power applied to the conductor plate and multiplied by $2\pi$.

Then, a sum of complex number of the projections with respect to the X-axis and the Y-axis of the current vectors induced on the narrow conductors 101 constituting to the first conductor plate 1, and a sum of the calculated phase difference and an argument of a sum of complex number of the projections to the X-axis and the Y-axis of the current vectors induced on the narrow conductors 101 constituting the second conductor plate 2 are calculated.

At this time, the rectangular conductors 100 are arranged to form the first conductor plate 1 and the second conductor plate 2 such that that the absolute values (amplitudes) are approximately equal to each other and the a difference between the arguments (phase difference) is approximately 90° as for the complex number sum with respect to the X-axis and the complex number sum with respect to the Y-axis.

In the first preferred embodiment, an electric length between one rectangular conductor 100 and another rectangular conductor 100 that can be realized in this antenna structure comprising the first conductor plate 1, the second conductor plate 2, and the coupling conductor 3 can be made longer than that of the antenna structure comprising a single conductor plate. In the antenna comprising the single conductor plate, since the electric length is obtained only through a path along the single conductor plate, the electric length cannot be set longer than the dimensions of the conductor plate. On the other hand, in the antenna comprising a plurality of the conductor plates, the electric length is obtained through a long path across a plurality of the conductor plates via the conductor plate coupling a plurality of the conductor plates.

Accordingly, when a distance between the two conductor plates is smaller enough than the dimensions of the respective conductor plates in the antenna structure comprising two conductor plates, the electric length required for conducting the antenna operation can be realized in the antenna having smaller dimensions than that of the conventional antenna comprising a single conductor plate.

According to the first preferred embodiment shown in FIGS. 1A to 1E, when the opposing distance between the first conductor plate 1 and the second conductor plate 2 is 1/100 wavelength, the antenna having dimensions corresponding to 1/8 wavelength can be realized. Compared with the conventional antennas having dimensions corresponding to 1/2 wavelength or 1/4 wavelengths the dimensions of the antenna according to the first preferred embodiment is significantly reduced. Therefore, the small sized single feed circular polarized wave antenna can be realized in the first preferred embodiment according to the invention.

FIG. 2 is a flow chart showing a method for searching the conductor pattern of the distributed phase type circular polarized wave antenna in the first preferred embodiment according to the invention.

Referring to FIG. 2, an algorithm for determining a concrete structure of the first conductor plate 1 and the second conductor plate 2 each comprising a group of the rectangular conductors 100 in the distributed phase type circular polarized wave antenna will be explained.

The outline of steps shown in FIG. 2 is as follows.

Firstly, assuming that the first conductor plate 1 and the second conductor plate 2 are rectangular conductor plates respectively, respective rectangular conductor plates are virtually divided into minute square areas (square segments) A calculator randomly determines two states of the square segment, i.e. as to whether the square segment should be remained on a divided plane as a rectangular conductor constituting the first or second conductor plate or should be removed, to generate a probable antenna pattern (antenna candidate pattern). This process will be later explained in more detail.

For every antenna candidate pattern, a probable power feed point (candidate point) is set in inner sides of the square segments for all possibilities. For every possibility of the candidate point, antenna characteristics (an impedance matching state at the power feed point and an axis ratio in a distant radiated field) of the antenna candidate pattern are calculated. The antenna candidate patterns having the impedance matching and the axis ratio within an allowable range are adopted as the distributed phase type circular polarized wave antenna. A remaining rate of the square segment on the divided plane is predetermined at the time of conducting the random removal of the square segments. Herein, "the impedance matching and the axis ratio within allowable range" means that a reflection of the power due to a difference (mismatching) between an impedance at the power feed point and an impedance of the antenna is within an allowable range as well as the axis ratio which is an index showing a level of the circular polarized wave is within an allowable range.

The process shown in FIG. 2 will be explained in more detail.

At a step S1, a minute area remaining rate (R) is read. The minute area remaining rate R of the square segment on the divided plane is previously determined at the time of conducting the random removal process of the square segments.

At a step S2, divided plane dimensions (W×H) is read. As a matter of convenience, "W" and "H" are defined as shown in FIG. 1D. As shown in FIG. 1D, "W" and "H" are dimensions of each of the first conductor plate 1 and the second conductor plate 2, and "W" and "H" are orthogonal to each other.

At a step S3, minute area dimensions (w×h) are read. As shown in FIG. 1D, "w" and "h" are dimensions of the rectangular conductor 100 and orthogonal to each other.

At a step S4, a reflection coefficient tolerance (Tref), an amplitude ratio tolerance (Tα), and a phase difference tolerance (Tδ) are read and set as tolerance judgment value.

At a step S5, the minute areas on the divided plane are indexed. The indexing is conducted by successively numbering the square segments existing on the divided plane, and the calculation may be expressed as:

$$\text{Number } 1;\ 1\sim N\ [N=W/w\times H/h] \quad (1).$$

At a step S6, a minute area random remaining rate is calculated, and the calculation may be expressed as:

$$r(i)=0 \text{ or } 1 \text{ (1 is remained area, and 0 is removed area)} \quad (2), \text{ and}$$

$$M=\text{NUM}(i) \text{ for } r(i)=1,\ M/N=R \quad (3).$$

The formula (2) indicates that a value of r(i) is 0 or 1, and that the $i^{th}$ minute area is remained when the value of r(i) is 1 while the $i^{th}$ minute area is removed when the value of r(i) is 0.

The formula (3) indicates that a value of M/N is always kept at R wherein a M is a total number of factors in a set of i where the value of r(i) is 1.

At a step S7, a power feed point (fj) is sequentially set in the minute areas in the antenna candidate pattern, and the calculation may be expressed as:

$$\text{Fj: } 1\sim L\ [L=(W/w-1)\times H/h+W/w\times(H/h-1)] \quad (4)$$

Herein, fj means a number (serial number) given on each position of the power feed points. The formula (4) indicates an upper limit of possible value of fj obtained from given W, w, H, and h.

At a step S8, antenna characteristics are calculated to provide a power feed point reflection coefficient (ref).

At a step S9, a complex current in the minute area is calculated. For every minute area, a complex current Ih(r(i)) in a vertical (height) direction and a complex current Iw(r(i)) in a horizontal (widthwise) direction are calculated.

At a step S10, a complex current vectorial sum is calculated after obtaining the complex current in the minute area at the step S9. Herein, an amplitude ratio α and a phase difference δ in two directions (the widthwise direction w and the height direction h) orthogonal to each other are calculated.

The amplitude ratio α is given by:

$$\alpha=|\Sigma Ih(r(i))|/|\Sigma Iw(r(i)) \quad (5).$$

The phase difference δ is given by:

$$\delta=\angle\Sigma Ih(r(i))-\angle\Sigma Iw(r(i)) \quad (6).$$

At a step S11, it is judged as to whether following formula (7) is true or false by using the amplitude ratio α calculated at the step S10, the reflection coefficient amplitude (ref) calculated at the step S8, and the reflection coefficient tolerance (Tref), the amplitude ratio tolerance (Tα), and the phase difference tolerance (Tδ) read at the step S4.

This judgment is given by;

$$\text{ref}<\text{Tref}\cap|\alpha-1|\cap<T\alpha\cap|\delta-90|<T\delta \quad (7)$$

In the judgment at the step S11, if the formula (7) is judged as false (No), the calculation flow is returned to the step S6. Upon returning to the step S6, r(i) is varied randomly. As described above, the calculations at the steps S6 to S10 are newly conducted. As a result, the amplitude ratio α and the phase difference δ are varied and the calculated result at the step S11 is also changed.

If the formula (7) is judged as true (Yes), the calculation flow is end. When the formula (7) is judge as true, amplitudes of radiated electromagnetic wave with respect to two axes orthogonal to each other are approximately equal to each other, and an input impedance of the antenna matches with an input impedance of the high-frequency circuit, as well as a phase difference in the radiated electromagnetic wave with respect to the two axes orthogonal to each other is approximately 90°.

Next, a distributed phase type circular polarized wave antenna in a second preferred embodiment according to the invention will be explained referring to FIG. 3.

Figure 3:
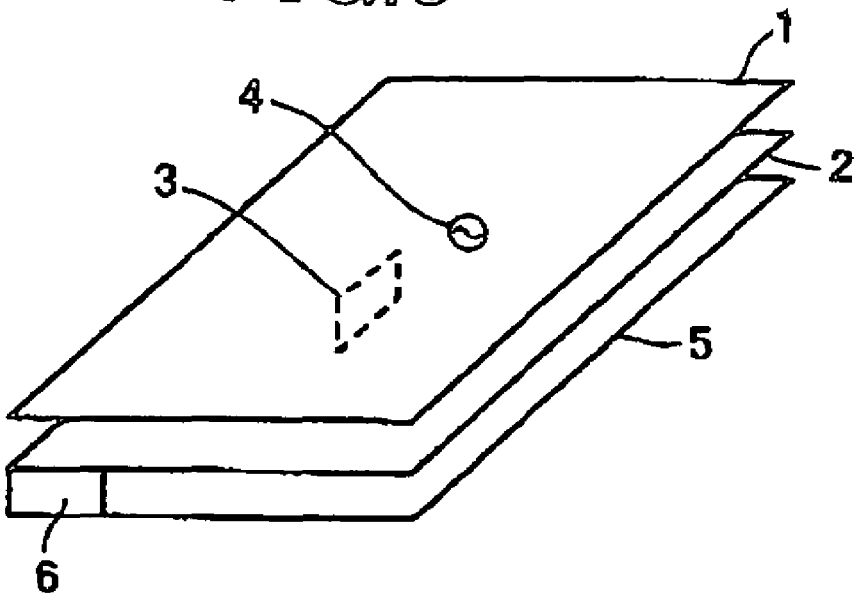
FIG. 3 is a perspective view of a distributed phase type circular polarized wave antenna in a second preferred embodiment according to the invention.

FIG. 3 is a perspective view of a distributed phase type circular polarized wave antenna in the second preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point 4 formed on the first conductor plate 1, a third conductor plate 5, and a second coupling conductor 6 for coupling the second conductor plate 2 and the third conductor plate 5.

The second preferred embodiment is different from the first preferred embodiment shown in FIG. 1 in that a third conductor plate S composed of a single rectangular conductor plate is disposed to be opposed to a second conductor plate 2 at a side different from a first conductor plate 1 with respect to the second conductor plate 2, and a part of the third conductor plate 5 and a part of the second conductor plate 2 are electrically coupled to each other by means of a second coupling conductor 6.

In the second preferred embodiment, the collective of the rectangular conductors composing the first conductor plate 1 and the second conductor plate 2 may be calculated by using the flowchart shown in FIG. 2, with considering the electromagnetic effect generated by the existence of the third conductor plate 5 and the second coupling conductor 6. In concrete, the collective of the rectangular conductors 100 constituting the first and second conductor plates 1, 2 may be calculated by further dividing the third conductor plate 5 into the square segments and considering a current induced on the square segments.

According to the second preferred embodiment, when the antenna is mounted on a circuit board, the electromagnetic effect that affects on a circuit board can be reduced, and a post-adjustment process for correcting alteration of the antenna characteristics after mounting the circuit board can be omitted. Further, an effect for reducing the manufacturing cost of the radio communication device mounting the antenna can be obtained.

Next, a distributed phase type circular polarized wave antenna in a third preferred embodiment according to the invention will be explained referring to FIG. 4.

Figure 4:
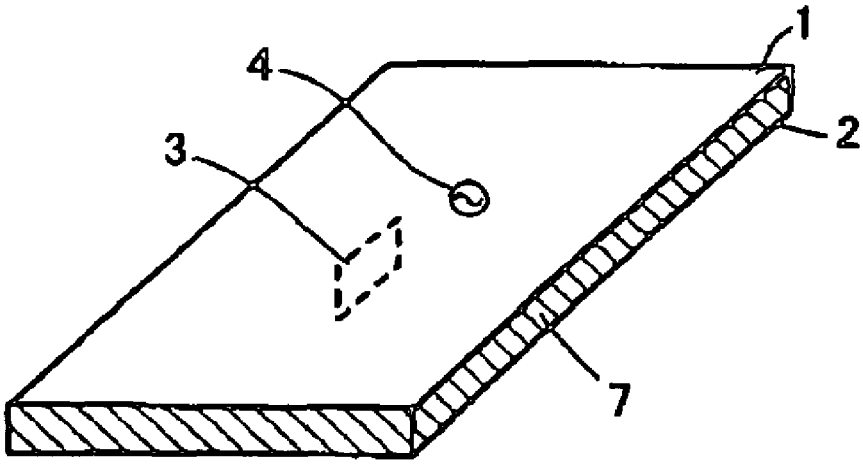
FIG. 4 is a perspective view of a distributed phase type circular polarized wave antenna in a third preferred embodiment according to the invention.

FIG. 4 is a perspective view of a distributed phase type circular polarized wave antenna in the third preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point 4 formed on the first conductor plate 4, and a dielectric material 7.

The third preferred embodiment is different from the first preferred embodiment shown in FIG. 1 in that a space between a first conductor plate 1 and a second conductor plate 2 is filled with a dielectric material 7.

According to the third preferred embodiment, since the electric material 7 is interposed at a region where electromagnetic field energy is concentrated between the first conductor plate 1 and the second conductor plate 2, the wavelength of the electromagnetic wave relating to the antenna operation can be compacted by interposing the dielectric material 7. As a result, the antenna structure can be miniaturized. Therefore, an effect for reducing the dimensions of the distributed phase type circular polarized wave antenna in the first preferred embodiment shown in FIG. 1 can be obtained.

Next, a distributed phase type circular polarized wave antenna in a fourth preferred embodiment according to the invention will be explained referring to FIG. 5.

Figure 5:
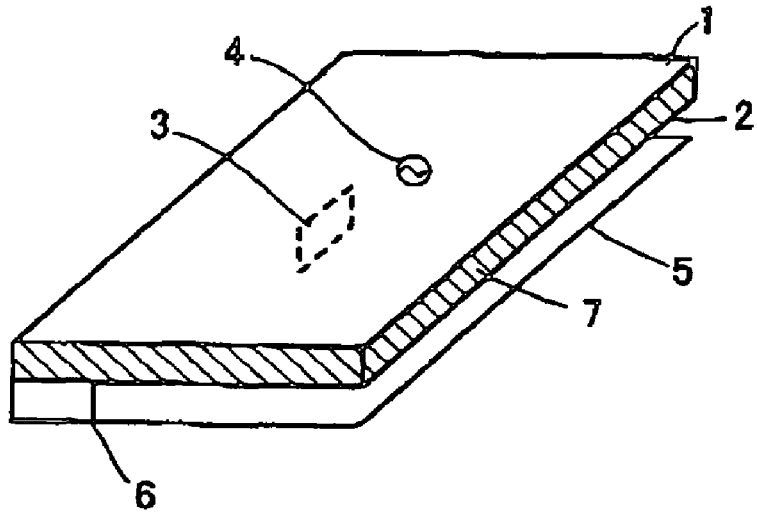
FIG. 5 is a perspective view of a distributed phase type circular polarized wave antenna in a fourth preferred embodiment according to the invention.

FIG. 5 is a perspective view of a distributed phase type circular polarized wave antenna in the fourth preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point a formed on the first conductor plate 4, a third conductor plate 5, a second coupling conductor 6 for coupling the second conductor plate 2 and the third conductor plate 5, and a dielectric material 7.

The fourth preferred embodiment is different from the third preferred embodiment shown in FIG. 4 in that the third conductor plate 5 composed of a single rectangular conductor plate is disposed to be opposed to the second conductor plate 2 at a side different from a first conductor plate 1 with respect to the second conductor plate 2, and a part of the third conductor plate 5 and a part of the second conductor plate 2 are electrically coupled to each other by means of a second coupling conductor 6.

According to the fourth preferred embodiment, when the antenna is mounted on a circuit board, the electromagnetic effect that affects on a circuit board can be reduced, and a post-adjustment process for correcting alteration of the antenna characteristics after mounting the circuit board can be omitted. Further, an effect for reducing the manufacturing cost of the radio communication device mounting the antenna can be obtained.

Next, a distributed phase type circular polarized wave antenna in a fifth preferred embodiment according to the invention will be explained referring to FIG. 6.

Figure 6:
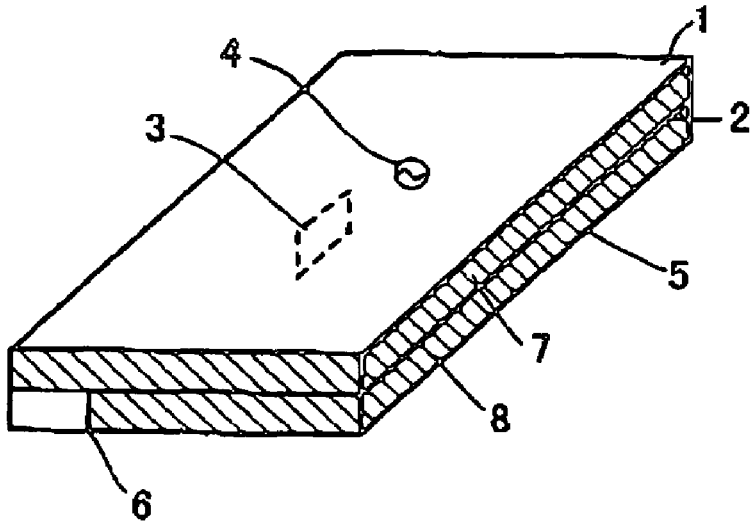
FIG. 6 is a perspective view of a distributed phase type circular polarized wave antenna in a fifth preferred embodiment according to the invention.

FIG. 6 is a perspective view of a distributed phase type circular polarized wave antenna in the fifth preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point a formed on the first conductor plate 4, a third conductor plate 5, a second coupling conductor 6 for coupling the second conductor plate 2 and the third conductor plate 5, a first dielectric material 7 interposed between the first conductor plate 1 and the second conductor plate 2, and a second dielectric material 8 interposed between the second conductor plate 2 and the third conductor plate 5.

The fifth preferred embodiment is different from the fourth preferred embodiment shown in FIG. 5 in that a space between the second conductor plate 2 and a third conductor plate 5 is filled with a second dielectric material 5.

According to the fifth preferred embodiment, since the first and second dielectric materials 7, 8 are interposed at regions where electromagnetic field energy is concentrated between the first conductor plate 1 and the second conductor plate 2 and between the second conductor plate 2 and the third conductor plate 5, the wavelength of the electromagnetic wave relating to the antenna operation can be compacted by interposing the dielectric material 7. As a result, the antenna structure can be miniaturized. Therefore, an effect for reducing the dimensions of the distributed phase type circular polarized wave antenna in the third preferred embodiment shown in FIG. 4 can be obtained.

Next, a distributed phase type circular polarized wave antenna in a sixth preferred embodiment according to the invention will be explained referring to FIG. 7.

Figure 7:
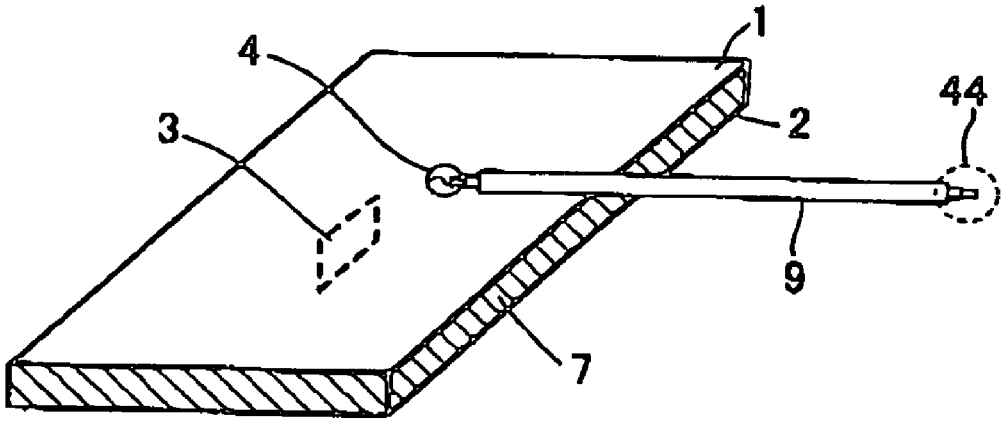
FIG. 7 is a perspective view of a distributed phase type circular polarized wave antenna in a sixth preferred embodiment according to the invention.

FIG. 7 is a perspective view of a distributed phase type circular polarized wave antenna in the sixth preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point 4 formed on the first conductor plate 4, a dielectric material 7 interposed between the first conductor plate 1 and the second conductor plate 2, and a coaxial cable 9. A core and a coated wire of the coaxial cable 9 are electrically coupled to an excitation potential and a grounding potential of the power feed point 4 at one end of the coaxial cable 9, and another end of the coaxial cable 9 is provided as a power feed point 44 for external connection.

According to the sixth preferred embodiment, since the power feed point of the antenna can be taken to the outside by using the coaxial cable, there is an effect to increase the choice of design for locating the antenna and the high-frequency circuit for supplying the high-frequency power to the antenna in the radio communication device.

Next, a distributed phase type circular polarized wave antenna in a seventh preferred embodiment according to the invention will be explained referring to FIG. 8.

Figure 8:
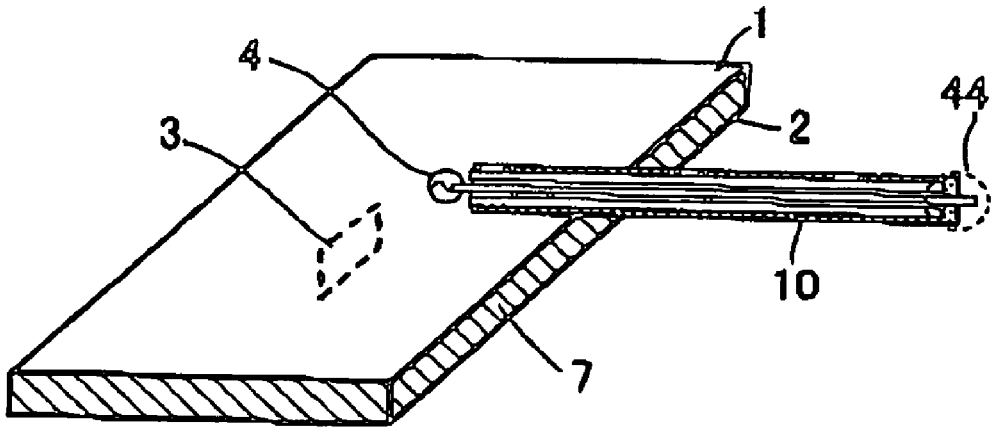
FIG. 8 is a perspective view of a distributed phase type circular polarized wave antenna in a seventh preferred embodiment according to the invention.

FIG. 8 is a perspective view of a distributed phase type circular polarized wave antenna in the seventh preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point a formed on the first conductor plate 4, a dielectric material 7 interposed between the first conductor plate 1 and the second conductor plate 2, and a flexible printed board 10. The flexible printed board 10 may include a flexible printed cable. A hot conductor and a grounded conductor in coplanar lines formed from the flexible printed board 10 are electrically coupled to an excitation potential and a grounding potential of the power feed point 44 at one end of the flexible printed board 10, and another end of the flexible printed board 10 is provided as a power feed point 44 for external connection.

According to the seventh preferred embodiment, since the flexible printed board 10 is used in place of the coaxial cable 9 in the sixth preferred embodiment shown in FIG. 7 and the manufacturing cost of the flexible printed board 10 is lower than that of the coaxial cable 9, the manufacturing cost of the whole antenna device can be reduced. In addition, since the power feed point of the antenna can be taken to the outside in an electrically equivalent manner by using the flexible printed board 10, there is an effect to increase the choice of design for locating the antenna and the high-frequency circuit for supplying the high-frequency power to the antenna in the radio communication device.

Next, a distributed phase type circular polarized wave antenna in an eighth preferred embodiment according to the invention will be explained referring to FIG. 1.

Figure 9:
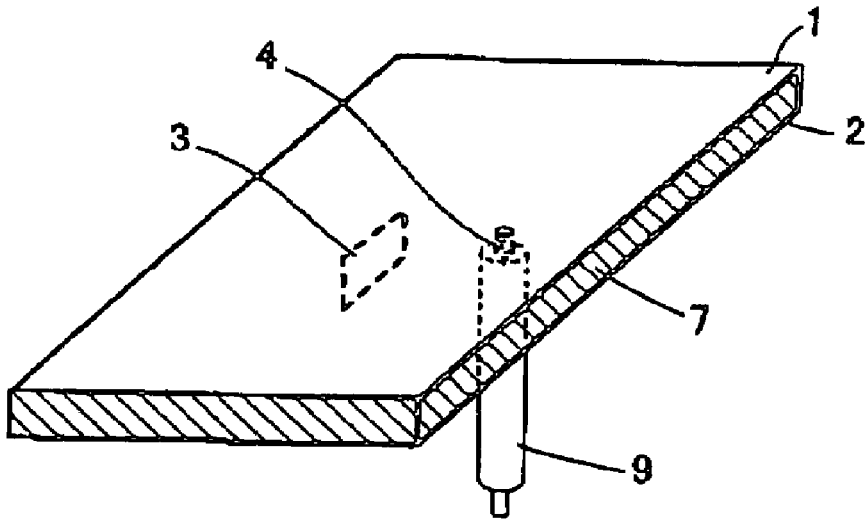
FIG. 9 is a perspective view of a distributed phase type circular polarized wave antenna in an eighth preferred embodiment according to the invention.

FIG. 9 is a perspective view of a distributed phase type circular polarized wave antenna in the eighth preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point 4 formed on the first conductor plate 4, a dielectric material 7 interposed between the first conductor plate 1 and the second conductor plate 2, and a coaxial cable 9. A core and a coated wire of the coaxial cable 9 are electrically coupled to an excitation potential and a grounding potential of the power feed point 4 at one end of the coaxial cable 9. The eighth preferred embodiment is different from the third preferred embodiment shown in FIG. 4 in that the coaxial cable 9 passes through the second conductor plate 2 without electrically contacting with the second conductor plate 2, sequentially passes through the dielectric material 7. A core and a coated wire of the coaxial cable 9 are electrically coupled to an excitation potential and a grounding potential of the power feed point 4 provided on the first conductor plate 1 at one of the coaxial cable 9.

According to the eighth preferred embodiment, since the coaxial cable 9 will not shield the electromagnetic wave mainly radiated from the first conductor plate 1 when taking the power feed point 4 of the antenna by using the coaxial line 9 outside, the electric wave radiation efficiency of the antenna can be improved. As a result, it is effective for improving a gain of the antenna.

Next, a distributed phase type circular polarized wave antenna in a ninth preferred embodiment according to the invention will be explained referring to FIG. 10.

Figure 10:
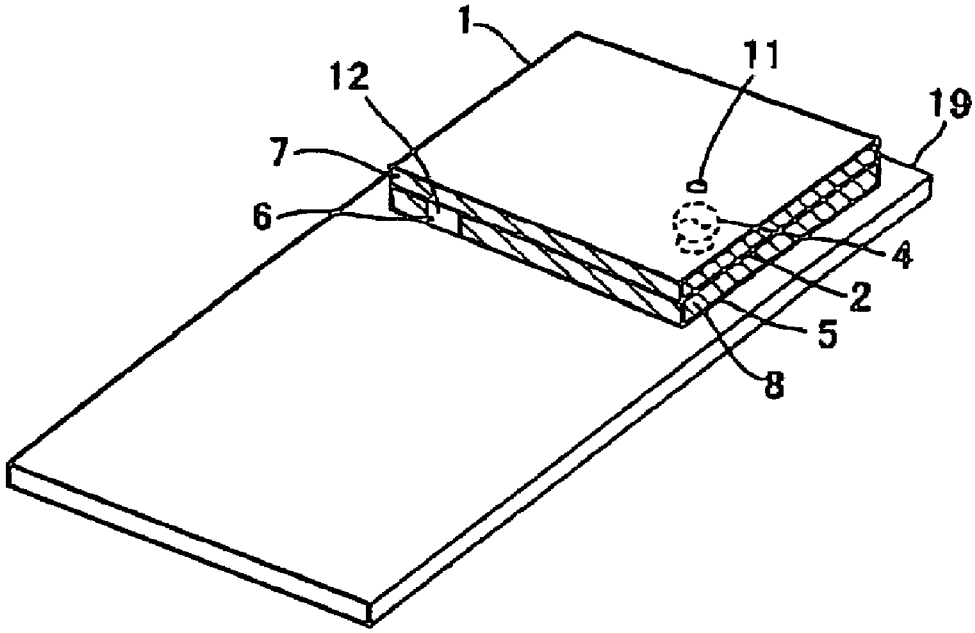
FIG. 10 is a perspective view of a distributed phase type circular polarized wave antenna mounted on a circuit board in a ninth preferred embodiment according to the invention.

FIG. 10 is a perspective view of a distributed phase type circular polarized wave antenna mounted on a circuit board in a ninth preferred embodiment according to the invention.

A distributed phase type circular polarized wave antenna comprises a first conductor plate 1, a second conductor plate 2, a first coupling conductor 3 for coupling the first conductor plate 1 and the second conductor plate 2, a power feed point 4 formed on the first conductor plate 4, a third conductor plate 5, a second coupling conductor 6 for coupling the second conductor plate 2 and the third conductor plate 5, a first dielectric material 7 interposed between the first conductor plate 1 and the second conductor plate 2, and a second dielectric material 8 interposed between the second conductor plate 2 and the third conductor plate 5, and the antenna is installed on a finite grounded conductor 19 such as a circuit board. Namely, the distribute phase type circular polarized wave antenna in the fifth preferred embodiment shown in FIG. 6 is mounted on the finite grounded conductor 19. Herein, the finite grounded conductor 19 is a conductor with finite dimensions which functions as a grounding potential for the high-frequency. The third conductor plate 5 is electrically coupled to a grounding potential of the finite grounded conductor 19. A grounding potential coupling point 12 at a point on the second conductor plate 2 is electrically coupled to a grounding potential of the finite grounded conductor 19, and an excitation potential coupling point 11 at a point on the first conductor plate 1 is electrically coupled to an excitation potential.

According to the ninth preferred embodiment, the power for the antenna is fed between the first conductor plate 1 and the second conductor plate 2. However, since a distance between the first conductor plate 1 and the second conductor plate 2 is small enough in comparison with the lasing wavelength, it is assumed that the antenna operations in the fifth preferred embodiment shown in FIG. 6 and in the ninth preferred embodiment are approximately same. When inspecting the characteristics of the respective candidates for the distributed phase type circular polarized wave antenna according to present invention, the electromagnetic effect of the finite grounded conductor 19 can be incorporated. By using such the antenna search technique, it is possible to realize the antenna search previously incorporating the alteration of the antenna characteristics when the antenna is installed on the circuit board, etc.. It is effective for controlling characteristic degradation in mounting the antenna in a radio communication device.

Next, a distributed phase type circular polarized wave antenna in a tenth preferred embodiment according to the invention will be explained referring to FIGS. 11A and 11B.

Figure 11A:
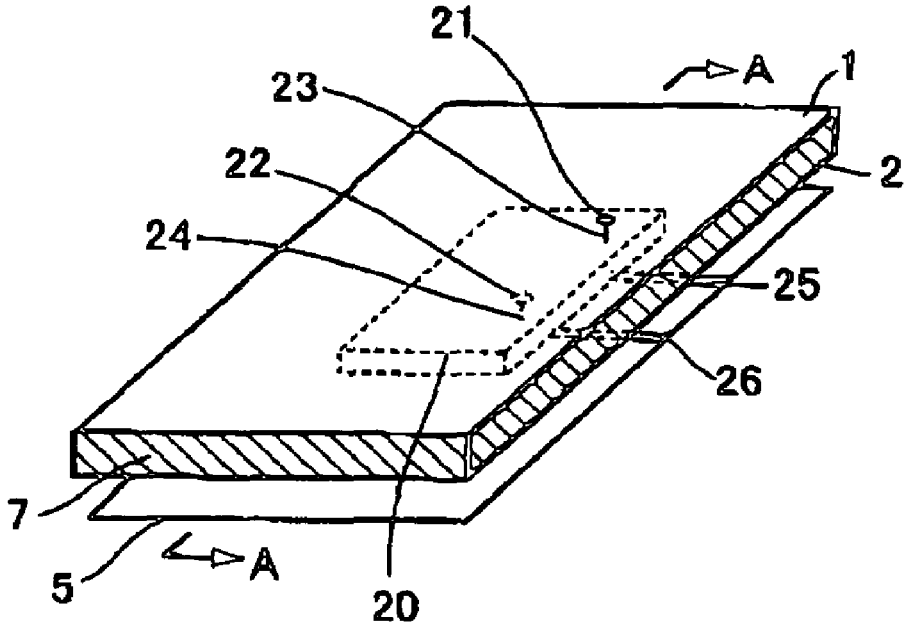
Figure 11B:
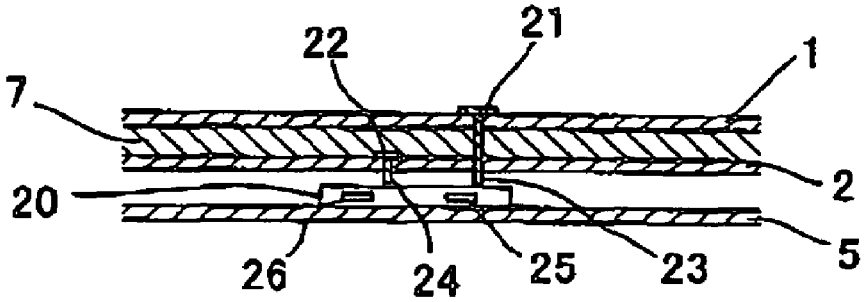

FIGS. 11A and 11B are schematic diagrams showing a high-frequency module using the distributed phase type circular polarized wave antenna in a tenth preferred embodiment according to the invention, wherein FIG. 11A is a perspective view of the high-frequency module and FIG. 11B is a cross sectional view of the high-frequency module viewed cut along A-A line.

A high-frequency module comprises a first conductor plate 1, a second conductor plate 2, a third conductor plate 5, a dielectric material 7 interposed between the first conductor plate 1 and the second conductor plate 2, a high-frequency receiving circuit 20 contacting with the third conductor plate 5 which functions as a grounded conductor, a high-frequency signal point 21 provided at a point on the first conductor plate 1, a high-frequency grounding point 22 provided at a point on second conductor plate 2, a high-frequency input line 23 for the high-frequency circuit 20 being electrically coupled to the high-frequency signal point 21, a high-frequency grounding line 24 for the high-frequency circuit 20 being electrically coupled to the high-frequency grounding point 22, an output line 25 for providing an output of the high-frequency circuit 20, and a power source line 26 for supplying the power to the high-frequency circuit 20.

The electromagnetic wave captured by the first conductor plate 1 and the second conductor plate 2 is supplied with low loss to the high-frequency circuit 20 via the high-frequency signal line 21 and the high-frequency grounding wire 24 in a short distance, and output via the high-frequency output line 25 after the electric processing such as amplification, frequency conversion.

According to the tenth preferred embodiment, since a thin type high-frequency reception module integrating an antenna can be realized, a volume of the high-frequency reception module itself can be reduced, a choice of design for mounting the high-frequency module on a radio device can be improved, and an occupying volume of the high-frequency reception module within the radio communication device can be reduced. As a result, it is effective for miniaturization and sliming of the radio communication device.

Next, a distributed phase type circular polarized wave antenna in an eleventh preferred embodiment according to the invention will be explained referring to FIG. 12.

Figure 12:
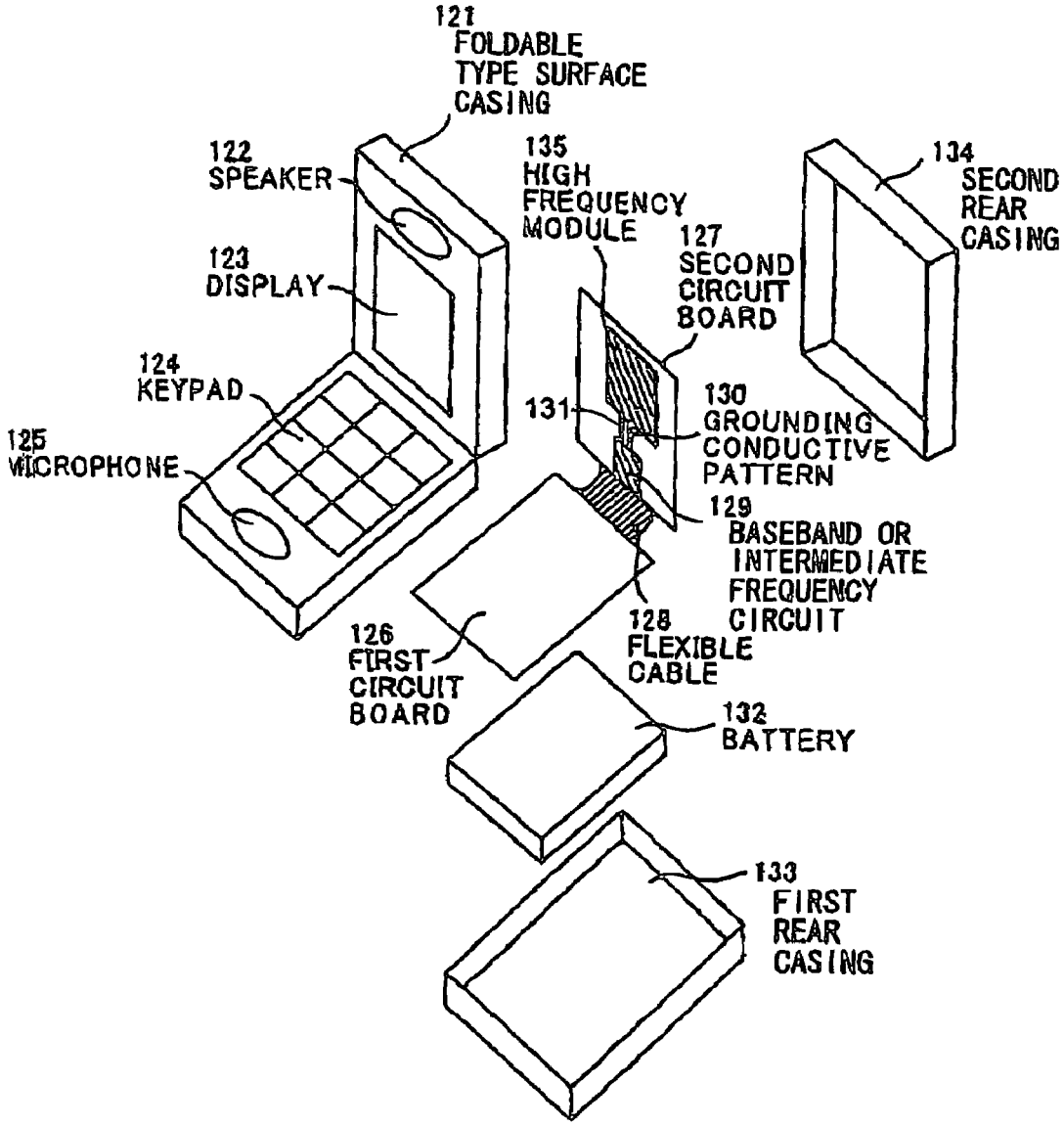
FIG. 12 is a disassembled perspective view of a radio communication device mounting a high-frequency module in an eleventh preferred embodiment according to the present invention.

FIG. 12 is a disassembled perspective view of a communication device mounting a high-frequency module in the eleventh preferred embodiment according to the present invention.

A speaker 122, a display 123, a keypad 124, and a microphone 125 are mounted on a foldable type surface casing 121. A first circuit board 126 and a second circuit board 127 are connected by a flexible cable 128 accommodated within the foldable type casing 121. On the first circuit board 326 and/or second circuit board 127, a baseband or intermediate frequency circuit 129 and a high-frequency module 135 according to the invention are mounted, and grounded conductor patterns 130, 131 for coupling a signal of the high-frequency module 135 and the baseband or intermediate frequency circuit 129, a control signal, and a power source is formed thereon. The first circuit board 126 and second circuit board 127 together with a battery 132 are accommodated in a first rear casing 133 and a second rear casing 134.

A characteristic feature of this structure is that the high-frequency module 135 according to the present invention is located on an opposite side of the display 123 or the microphone 125 with respect to the circuit board.

According to the eleventh preferred embodiment, a radio communication terminal enjoying plural radio system services can be realized in a form of a built-in antenna. Therefore, it is effective in miniaturization of the radio communication terminal and improvement of user's convenience for storage and portability.

Next, a distributed phase type circular polarized wave antenna in a twelfth preferred embodiment according to the invention will be explained referring to FIG. 13.

Figure 13:
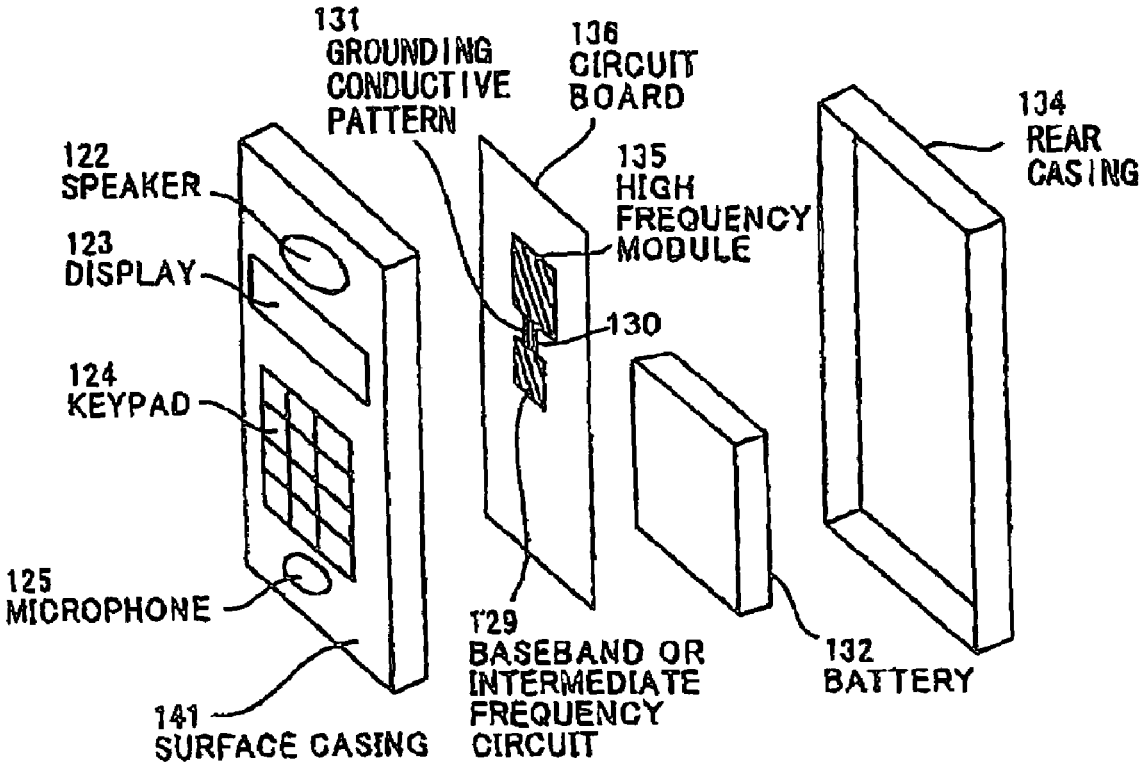
FIG. 13 is a disassembled perspective view of a portable radio communication device mounting a high-frequency module in a twelfth preferred embodiment according to the present invention.

FIG. 13 shows a disassembled perspective view of a portable radio communication device mounting a high-frequency module in the twelfth preferred embodiment according to the present invention.

A speaker 122, a display 123, a keypad 124, and a microphone 135 are mounted on a surface casing 141, and a circuit board 136 is accommodated within the surface casing 141. On the circuit board 136, a baseband or intermediate frequency circuit 129 and a high-frequency module 135 according to the invention are mounted, and grounded conductor patterns 130, 131 for coupling a signal of the high-frequency module 135 and the baseband or intermediate frequency circuit 129, a control signal, and a power source is formed. The circuit board 136 together with a battery 132 is accommodated in a rear casing 134.

A characteristic feature of this structure is that the high-frequency module 135 according to the present invention is sandwiching the circuit board and located on an opposite side the microphone 125, the speaker 122, or the keypad 124 with respect to the circuit board.

According to the twelfth preferred embodiment, a portable radio communication terminal enjoying plural radio system services can be realized in a form of a built-in antenna. Therefore, it is effective in miniaturization of the radio communication terminal and improvement of user's convenience for storage and portability.

Compared with the eleventh preferred embodiment shown in FIG. 12, since the circuit board and the casing can be fabricated integrally, it is effective for miniaturization of the terminal surface and reduction of manufacturing cost by reducing the number of assembling steps.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A distributed phase circular polarized wave antenna, comprising:

a power feed point;

a first conductor plate comprising a plurality of narrow conductors having a substantially one-dimensional current distribution and distributed in two dimensions;

a second conductor plate comprising a plurality of narrow conductors having the substantially one-dimensional current distribution and distributed in the two dimensions; and a coupling conductor for connecting the first conductor plate and the second conductor plate, wherein the power feed point is provided such that a grounding potential is connected to one of the narrow conductors composing the first and second conductor plates and an excitation potential is connected to another of the narrow conductors composing the first and second conductor plates, and wherein sums of projections of complex vectors of current distributions induced on the narrow conductors in first and second directions orthogonal to each other defined on the first conductor plate and second conductor plate are determined in amplitude and phase, such that amplitudes are approximately equal to each other and a phase difference is approximately 90°.

2. The distributed phase circular polarized wave antenna, according to claim 1, wherein the first conductor plate and the second conductor plate are formed on a grounded conductor plate having a finite area and a grounding potential.

3. The distributed phase circular polarized wave antenna, according to claim 2, wherein a space between the first conductor plate and The second conductor plate, and between The second conductor plate and the grounded conductor plate is filled with a dielectric material.

4. The distributed phase circular polarized wave antenna, according to claim 1, further comprising a coaxial cable having an end coupled to the power feed point and another end being a power feed point to be connected with an element outside the antenna.

5. The distributed phase circular polarized wave antenna, according to claim 1, further comprising a flexible printed cable having an end coupled to the power feed point and another end being a power feed point to be connected with an element outside The antenna.

6. A high-frequency module, comprising:

a distributed phase circular polarized wave antenna which comprises:

a power feed point;

a first conductor plate comprising a plurality of narrow conductors having a substantially one-dimensional current distribution and distributed in two dimensions;

a second conductor plate comprising a plurality of narrow conductors having the substantially one-dimensional current distribution and distributed in the two dimensions; and a coupling conductor for connecting the first conductor plate and the second conductor plate, wherein the power feed point is provided such that a grounding potential is connected to one of the narrow conductors composing the first and second conductor plates and an excitation potential is connected to another of the narrow conductors composing the first and second conductor plates, and wherein sums of projections of complex vectors of current distributions induced on the narrow conductors in first arid second directions orthogonal to each other defined on the first conductor plate and the second conductor plate are determined in amplitude and phase, such that amplitudes are approximately equal to each other and a phase difference is approximately 90°.

7. A portable radio communication terminal, comprising:

a distributed phase circular polarized wave antenna which comprises:

a power feed point;

a first conductor plate comprising a plurality of narrow conductors having a substantially one-dimensional current distribution and distributed in two dimensions;

a second conductor plate comprising a plurality of narrow conductors having the substantially one-dimensional current distribution and distributed in the two dimensions; and a coupling conductor for connecting the first conductor plate and the second conductor plate, wherein the power feed point is provided such that a grounding potential is connected to one of the narrow conductors composing the first and second conductor plates and an excitation potential is connected to another of the narrow conductors composing the first and second conductor plates, and wherein sums of projections of complex vectors of current distributions induced on the narrow conductors in first and second directions orthogonal to each other defined on the first conductor plate and the second conductor plate are determined in amplitude and phase, such that amplitudes are approximately equal to each other and a phase difference is approximately 90°.

8. A portable radio communication terminal, comprising:

a high-frequency module including a distributed phase circular polarized wave antenna which comprises:

a power feed point;

a first conductor plate comprising a plurality of narrow conductors having a substantially one-dimensional current distribution and distributed in two dimensions;

a second conductor plate comprising a plurality of narrow conductors having the substantially one-dimensional current distribution and distributed in the two dimensions; and a coupling conductor for connecting the first conductor plate and the second conductor plate, wherein the power feed point is provided such that a grounding potential is connected to one of the narrow conductors composing the first and second conductor plates and an excitation potential is connected to another of the narrow conductors composing the first and second conductor plates, and wherein sums of projections of complex vectors of current distributions induced on the narrow conductors in first and second directions orthogonal to each other defined on the first conductor plate and the second conductor plate are determined in amplitude and phase, such that amplitudes are approximately equal to each other and a phase difference is approximately 90°.

9. The distributed phase circular polarized wave antenna according to claim 1, further comprising:

a third conductor plate comprising a plurality of narrow conductors having the substantially one-dimensional cm-rent distribution and distributed in the two dimensions, the third conductor plate opposing the second conductor plate at a side different from the first conductor plate with respect to the second conductor plate; and a second coupling conductor for connecting the third conductor plate and the second conductor plate, wherein sums of projections of complex vectors of current distribution induced on the narrow conductors in first and second directions orthogonal to each other defined on the third conductor plate is determined in amplitude and phase, such that an amplitude of the third conductor plate is approximately equal to amplitudes of the first and second conductor plates.

10. The distributed phase circular polarized wave antenna according to claim 9, wherein a space between the third conductor plate and the second conductor plate is filled with a dielectric material and a space between the first conductor plate and the second conductor plate is filled with the dielectric material.

11. The distributed phase circular polarized wave antenna according to claim 9, wherein a space between the third conductor plate and the second conductor plate is filled with a dielectric material and a space between the second conductor plate and the first conductor plate is filled with a dielectric material which is different from the dielectric material formed between the second and third conductor plates.

12. The distributed phase circular polarized wave antenna according to claim 4, wherein a space between the first conductor plate and the second conductor plate is filled with dielectric material, and the coaxial cable passes through the dielectric material and passes through the second conductor plate without electrically contacting the second conductor plate.

13. The distributed phase circular polarized wave antenna according to claim 11, wherein the first conductor plate and the second conductor plate are formed on a grounded conductor plate having a finite area and a grounding potential, and the third conductor plate is electrically coupled to the grounding potential of the grounded conductor plate.

* * * * *